US005121845A

United States Patent [19]

Blanchard

[11] Patent Number: 5,121,845

[45] Date of Patent: Jun. 16, 1992

[54] REMOVABLE SEAL FOR LIQUID CONTAINER

[76] Inventor: Floyd W. Blanchard, 4272A Florence Ave., Bell, Calif. 90201

[21] Appl. No.: 598,048

[22] Filed: Oct. 16, 1990

[51] Int. Cl.[5] ..... B65D 51/00

[52] U.S. Cl. ..... 215/232; 215/250; 215/295; 220/258; 220/359

[58] Field of Search ..... 215/232, 257, 295, 305, 215/228, 250, 254; 220/258, 270, 276, 359, 379, 212, 265, 277, 278; 141/363, 364

[56] References Cited

U.S. PATENT DOCUMENTS

| | | | |
|---|---|---|---|
| 4,605,136 | 8/1986 | Debetencourt | 215/232 |
| 4,739,892 | 4/1988 | Tudek | 215/232 |
| 4,767,016 | 8/1988 | Cook, Jr. et al. | 215/230 |
| 4,778,698 | 10/1988 | Ou-Yang | 428/35 |
| 4,782,967 | 11/1988 | Thomas | 215/231 |
| 4,789,082 | 12/1988 | Sampson | 222/1 |
| 4,815,618 | 3/1989 | Gach | 215/232 |
| 4,819,817 | 4/1989 | Robertson, Jr. | 215/230 |
| 4,863,061 | 9/1989 | Moore | 220/258 |
| 4,869,383 | 9/1989 | Bahr et al. | 215/232 |
| 4,893,718 | 1/1990 | Delespaul et al. | 215/232 |
| 4,953,729 | 9/1990 | Kloosterhouse | 215/255 |
| 4,969,557 | 11/1990 | Oka | 206/527 |
| 5,018,560 | 5/1991 | Tsukamoto | 141/364 |

FOREIGN PATENT DOCUMENTS

| | | | |
|---|---|---|---|
| 9009935 | 9/1990 | World Int. Prop. O. | 215/232 |

*Primary Examiner*—Stephen Marcus
*Assistant Examiner*—Stephen Cronin
*Attorney, Agent, or Firm*—Roy A. Ekstrand

[57] ABSTRACT

A molded plastic oil bottle includes an upwardly extending threaded neck having a sealing edge. A cup-shaped cap is threadably received upon the neck to provide closure thereof. A quantity of oil is received within the molded plastic bottle. A removable seal comprises a thin seal membrane secured to the edge of the bottle neck and includes an outwardly extending tab which is used to remove the seal from the bottle in the filling process. In one embodiment, the extending tab is multiply folded and received within the cap while in alternate embodiments the tab extends outwardly from beneath the cap in the closed position. In a still further embodiment, a smaller tab having an aperture therein extends from the seal member and is operated by a separate puller which is attachable to the tab.

7 Claims, 2 Drawing Sheets

REMOVABLE SEAL FOR LIQUID CONTAINER

FIELD OF THE INVENTION

This invention relates generally to containers for liquids such as motor oils and the like and particularly to devices for simplifying the addition of such motor oils to motor vehicles.

BACKGROUND OF THE INVENTION

One of the most persistent maintenance tasks associated with automobile and other motor vehicles use is that associated with maintenance of the required quantity of motor oil within the engine. Even the best of automobiles seems to require occasional oil added to the crank case to maintain the appropriate level. Thus, while periodic maintenance at automobile service facilities may attend to the required changes of motor oil, virtually all vehicle operators find themselves required to add motor oil from time to time. As is often the case, such addition of motor oil is required at times which are inconvenient for the user. Most motor oils are packaged and sold in quart size containers which in early years comprised cylindrical cans having generally flat top and bottom services. Such cans were extremely messy to use without the aid of a large funnel or the like and in recent years have been replaced by molded plastic bottle-like containers having extended neck portions and molded plastic caps. The latter are generally removable in a threaded attachment. While the advent and proliferation of such molded plastic containers has, to some extent, reduced the mess associated with the addition of oil to the vehicle crank case, it still remains a messy and inconvenient task.

In most cases, the fabrication and design of motor vehicle engine configurations has done little to improve the ease of adding motor oil by the consumer. In fact, despite this long standing need, motor vehicle engines are nonetheless designed with inconveniently located and difficult to reach crank case filling apertures. In typical motor vehicle engines, an upwardly extending tubular spout is provided somewhere near the outer edge of the engine. However, the extended distance between these spouts and the outer extremes of the automobile make the task of adding oil difficult nonetheless. In addition, many engines are designed which require adding oil through apertures which are near the center of the engine and therefore an extended distance from the vehicle perimeter. Vehicle operators have attempted to meet these problems by using a variety of devices such as funnels and the like. However, the use and storage of such devices is often as messy as the direct introduction of motor oil without their use.

The basic problem lies in the need to invert the oil container in a manner which avoids spilling oil onto the vehicle engine or associated components within the restricted access of the typical engine compartment.

Manufacturers of motor oil products have attempted to meet this need by providing various types of extendable spouts on the oil containers or spout extensions which are provided as an add on or premium item. These attempts have, to date, met with very limited success and a solution remains evasive. The problem is further exacerbated by the extreme economic pressure upon the manufacturers of motor oil products. Because the oil and its processing are expensive and because competition in the marketplace is extremely price sensitive, motor oil manufacturers must seek to minimize the costs associated with bottling and packaging the oil products. Thus, very little additional money is available within the product price to support complex or expensive bottling concepts for the sake of user convenience. In addition, the filling or bottling process of motor oil producers is an extremely automated high speed operation which yields substantial economic advantage but which is extremely intolerant of design changes of the bottle or its cap.

As a result, there remains a need in the art for a low cost and effective structure for facilitating the ease and cleanliness of adding motor oil to the typical motor vehicle. There remains a further need in the art to accomplish such an improved system without sacrificing the economic advantage associated with the present high speed automated mass production bottling processes used by most, if not all, manufacturers.

SUMMARY OF THE INVENTION

Accordingly, it is a general object of the present invention to provide an improved liquid container for motor oils and the like. It is a more particular object of the present invention to provide an improved motor oil container which facilitates the easy and clean addition of oil to the typical motor vehicle. It is a still more particular object of the present invention to provide such an improved system which is compatible with the high speed automated bottling processes prevalent in the motor oil industry.

In accordance with the present invention, there is provided for use in combination with a liquid container having an extending neck defining neck passage, a surrounding sealing edge and a container cap receivable upon the extending neck, a removable seal comprises: a thin flexible seal membrane sized and shaped to overlie at least a portion of the sealing edge and closing the neck passage; a tab portion extending from the seal membrane; and means for removable affixing the seal membrane exclusive of the tab portion to the sealing edge of the neck in a peelable sealing attachment, at least a portion of the tab portion being received within the cap when the cap is placed upon the neck.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
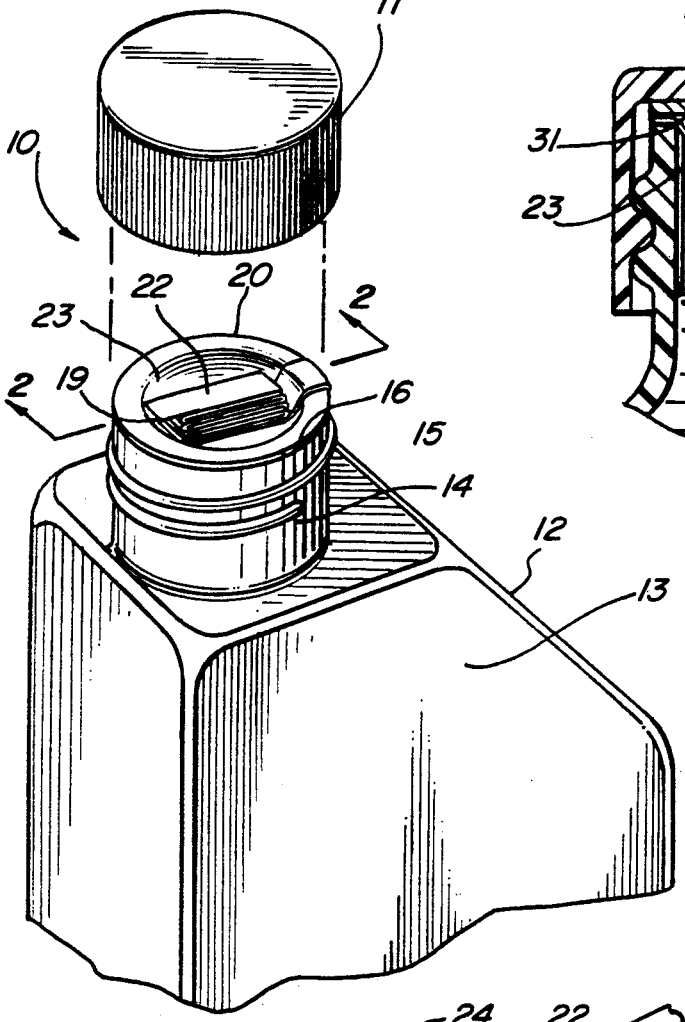
FIG. 1 sets forth a perspective view of a removable seal for liquid container constructed in accordance with the present invention.

FIG. 1 sets forth a perspective view of a removable seal constructed in accordance with the present invention and generally referenced by numeral 10. A conventional oil container 12 formed in a typical molded plastic bottle includes an interior oil reservoir 13 and an upwardly extending generally cylindrical neck 14. Neck 14 in further accordance with conventional fabrication techniques defines a generally flat annular upper edge 16 and a plurality of external threads 15. A generally cylindrical cap 11, the structure of which is set forth in greater detail in FIG. 2 is generally cup-shaped and is in accordance with conventional fabrication techniques threadably received upon neck 14 to provide closure of bottle 12.

In accordance with the present invention, a generally disk-shaped seal membrane is received within cap 11 in a snap-fit attachment and is carried by cap 11 to edge 16 during the assembly of cap 11 to neck 14 and attached thereto by conventional means such as an adhesive or the like. Seal membrane 20 further includes a tab 21 which, in its preferred form, is continuous with and integral with seal membrane 20. Tab 21 extends from the outer edge of seal membrane 20 and is folded back across seal membrane 20 and extends inwardly to form an elongated tab extension 22. As is seen in FIG. 1, tab extension 22 is folded in an accordion-like fold to compactly configure tab extension 22 at a position overlying the center portion of seal membrane 20 such that end portion 19 extends beyond the folds of tab extension 22 for easy handling. In further accordance with an important aspect of the present invention, seal membrane 20 is formed into a downwardly extending recess 23 during the assembly of cap 11 to neck 14. As is better seen in FIG. 2, membrane 20 extends into the interior of neck 14 beneath neck 16 thereof. In its preferred form, tab extension 22 in its folded configuration is received within recess 23 such that the upper portion of tab extension 22 is generally aligned with the portion of seal membrane 20 in contact with edge 16 of neck 14.

Thus, in the position shown in FIG. 1, cap 11 has been threaded upon neck 14 in accordance with conventional bottling practices and seal membrane 20 has been carried by cap 11 and attached to edge 16. Thus, seal membrane 20 does not interfere with the bottling process nor the attachment of cap 11 to neck 14.

Figure 2:
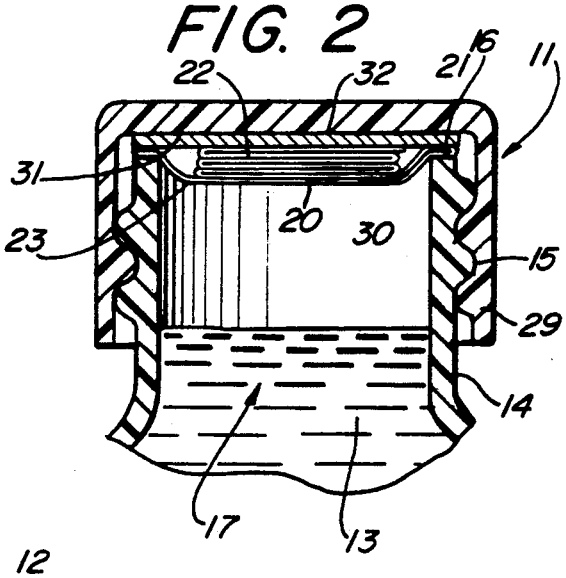
FIG. 2 sets forth a section view of the present invention removable seal taken along section lines 2—2 in FIG. 1.

With simultaneous reference now to FIG. 2, it can be seen more clearly that bottle 12 supports a quantity of oil 17 within oil reservoir 13. In addition, bottle 12 includes an upwardly extending neck 14 defining external threads 15 and an upper edge 16. Seal membrane 20 is carried by cap 11 and attached to edge 16 using a conventional adhesive or other attachment means. As mentioned above, seal membrane 20 is formed into a recess 23 when cap 11 is assembled to neck 14 which receives the multiple folds of tab extension 22 within the interior of neck 14. Cap defines a conventional cap structure having an upper surface 31 and defining a side surface 29 which in turn defines a plurality of internal threads 30. A somewhat resilient seal disk 32 preferably formed of a resilient plastic or cardboard or other conventional disk material may be captivated between upper surface 31 of cap 11 and seal membrane 20 and snap-fitted into cap 11 along with membrane 20. With cap 11 threadably secured to neck 14, seal disk 32 is compressively captivated between seal membrane 20 and edge 16 of neck 14. This resilient captivation provides an additional seal maintenance force upon membrane 20. It should be noted that in accordance with an important aspect of the embodiment of the present invention shown in FIGS. 1 and 2, the formation of recess 23 in seal membrane 20 permits tab extension 22 to be utilized without altering the structure of neck 14 and cap 11 from that conventionally used in the oil bottling process.

Figure 3:
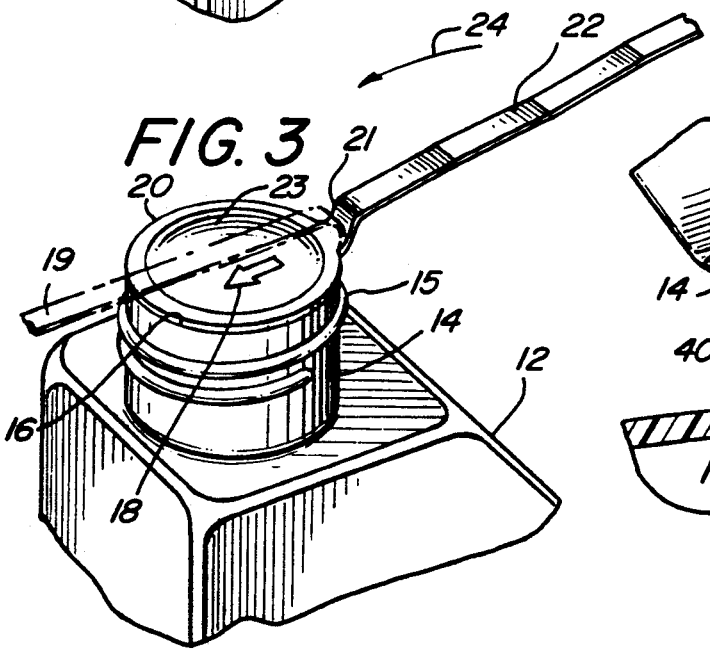
FIG. 3 sets forth a perspective view of the present invention removable seal being prepared for the filling operation.

FIG. 3 sets forth a perspective view of the present invention removable seal following removal of cap 11 and prior to and in preparation of the transfer of the oil 17 from bottle 12 to a vehicle engine. Thus, bottle 12 defines an upwardly extending cylindrical neck 14 having an upper edge 16 and a plurality of external threads 15. Seal membrane 20 defines a disk-shaped portion secured to edge 16 of neck 14 by a conventional process such as conventional adhesive. Seal membrane forms a recess 23 extending into the interior of neck 14. Seal membrane 20 further defines a tab 21, a tab extension 22 and an arrow 18 which indicates the direction of pull for tab extension 22. In the position shown in FIG. 3, tab extension 22 has been withdrawn from recess 23 and unfolded to form an extending "tail" which is coupled to seal membrane 20 by tab 21. The latter is unfolded from its previous position overlying seal membrane 20. In the position shown in FIG. 3, the seal between seal membrane 20 and edge 16 of bottle 12 is maintained due to the conventional adhesive type attachment therebetween. Thus, in the position shown in FIG. 3, bottle 12 may be inverted without spilling or discharging any of the oil supported therein. As a result, the engine filling operation described above is facilitated in that bottle 12 may now be inverted while tab 21 and tab extension 22 remain extending outwardly from neck 14. In its preferred use, the user simply inverts bottle 12 in one hand and grasps tab extension 22 in the other hand. Tab extension 22 is thereafter moved with respect to neck 14 in the direction indicated by arrow 24 to fold tab 21 upon seal membrane 20 and draw tab extension 22 across seal membrane 20 and beyond to the dashed line position shown in FIG. 3. Alternatively, the above-described motion of tab extension 22 to the dashed line position shown in FIG. 3 may be initiated prior to inverting bottle 12. The result is the same in that bottle 12 is inverted while being held in one hand in a manner permitting the user to simultaneously grasp tab extension 22 in the position shown in dashed line representation in FIG. 3.

Figure 4:
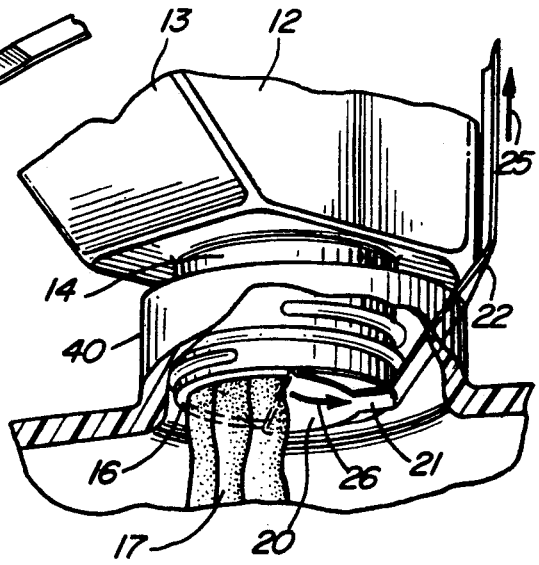
FIG. 4 sets forth a perspective view of the present invention removable seal filling a typical motor vehicle oil spout.

With respect to FIG. 4, bottle 12 which supports oil 17 within an oil reservoir 13 and which defines a downwardly extending neck 14 is shown in the inverted position referred to above. Also shown in FIG. 4 is a typical vehicle engine oil filler spout 40 which, as can be seen, defines a generally circular aperture for filling passage.

In the position shown in FIG. 4, bottle 12 has been inverted and positioned with respect to spout 40 such that neck 14 extends into spout 40. In accordance with an important aspect of the present invention, tab extension 22 extends outwardly from filler spout 40 and remains within the grasp of the user. After neck 14 is inserted into filler spout 40, the user simply draws tab extension 22 in the direction indicated by arrow 25 causing seal membrane 20 to be pulled from its attachment at edge 16 of neck 14. As tab extension 22 continues to be pulled in the direction of arrow 25, seal membrane 20 folds away from edge 16 and is peeled back in the direction indicated by arrow 26. As seal membrane 20 is peeled from edge 16, the quantity of oil 17 within bottle 12 flows downwardly into the vehicle engine to provide the desired oil transfer. If desired, the user may pull tab extension 22 to expose all of edge 16 and completely open neck 14. Thus, the transfer of oil 17 from bottle 12 to the vehicle engine is completed with virtually no danger of oil spillage and with virtually no mess or inconvenience to the user. Once the oil has been poured from bottle 12, it is removed from filler spout 40 and discarded. It should be noted that while the user may pull tab extension 22 in a manner completely removing seal membrane 20 from edge 16, it is merely necessary that the user pull tab extension 22 a sufficient distance to open neck 14 and thus seal membrane 20 need not be completely removed. This frees the user's one hand from holding tab extension 22 as bottle 12 is removed from filler spout 40.

It is important to note that the use of removable seal 10 facilitates the clean and easy transfer of oil from its container to a vehicle engine using a structure which is completely compatible with the high speed automated filling and bottling systems used by modern motor oil manufacturers.

Figure 5:
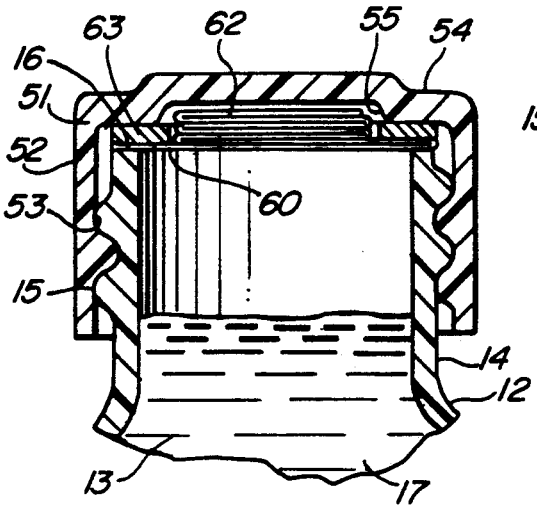
FIG. 5 sets forth a section view of an alternate embodiment of the present invention removable seal.

FIG. 5 sets forth a section view of an alternate embodiment of the removable seal shown in FIGS. 1 through 4. As can be seen, bottle 12 remains the same as that shown in FIG. 1 and defines an interior reservoir 13 filled with a quantity of oil 17 and an upwardly extending cylindrical neck 14. The latter defines a plurality of external threads 15 and an annular edge 16. A seal membrane 60 which is generally similar to seal membrane 20 described above is secured to edge 16 in a sealing attachment using a conventional adhesive or the like. Seal membrane 60 in further similarity to seal membrane 20 described above defines a tab 61 and a multiply folded tab extension 62. In contrast to seal membrane, however, seal membrane 60 does not form a recess extending into neck 14 but rather extends in a flat configuration generally parallel to edge 16. Thus, the multiple folds of tab extension 62 rest upon the center portion of seal membrane 60 and extend above edge 16. An annular compression ring 63 is received upon seal membrane 60 and overlies edge 16. To accommodate the upwardly extending folds of tab extension 62, the embodiment of FIG. 5 differs from that shown in FIG. 1 in that it provides a cap 51 having a generally cylindrical structure defining downwardly extending side portions 52 which in turn define internal threads 53 together with a top portion 54 which defines an upwardly extending recess 55. Recess 55 accommodates the multiple folds of tab extension 62 in the closed position shown in FIG. 5 and permits cap 51 to be threaded upon neck 14 to compress ring 63 and reinforce the seal between edge 16 and seal membrane 60. In all other respects, the embodiment shown in FIG. 5 is operated in the same manner as the embodiment shown in FIGS. 1 through 4.

Figure 6:
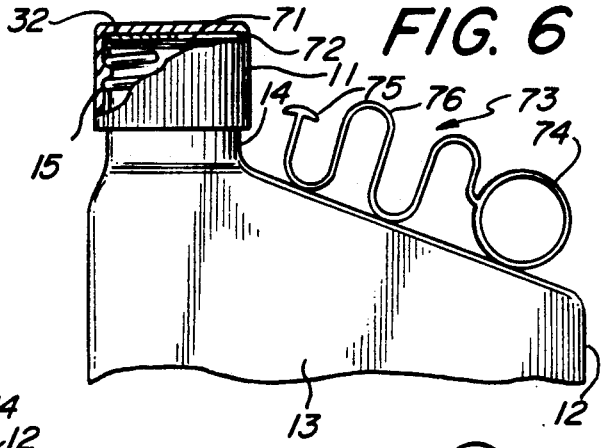
FIG. 6 sets forth a partially sectioned view of a still further alternate embodiment of the present invention removable seal.

FIG. 6 sets forth a partially sectioned view of an alternate embodiment of the present invention removable seal generally referenced by numeral 70. Bottle 12 and cap 11 are fabricated in the manner described above in FIGS. 1 through 4. Specifically, bottle 12 includes an oil reservoir 13 and an upwardly extending generally cylindrical neck 14. Neck 14 defines a plurality of external threads 15 and an annular flat edge 16. Cap 11 defines a cup-like cylindrical structure having a plurality of internal threads 30. A seal membrane 71 is adhesively secured to edge 16 in accordance with conventional fabrication techniques. Seal membrane 71 defines a tab 72 (better seen in FIG. 7) which is folded upon seal member 71. Cap 11 is threadably received upon neck 14 as described above and a compression disk 32 is interposed between seal member 71 and the upper surface of cap 11.

A puller member 73 includes a gripping portion comprising a ring portion 74, a leader portion 76 and a hook 75. While puller 73 may be packaged as a separate unit in combination with bottle 12, in its preferred form, puller 73 comprises a molded plastic element which may be integrally molded With bottle 12 and separable therefrom by tearing puller 73 from bottle 12.

Figure 7:
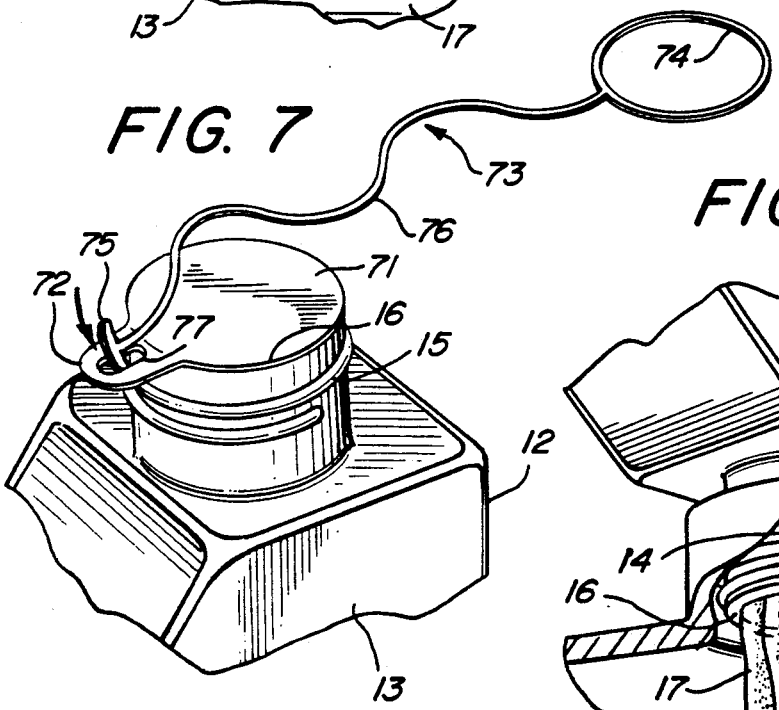
FIG. 7 sets forth a perspective view of the embodiment of the present invention removable seal shown in FIG. 6 at an intermediate phase of use.
Figure 8:
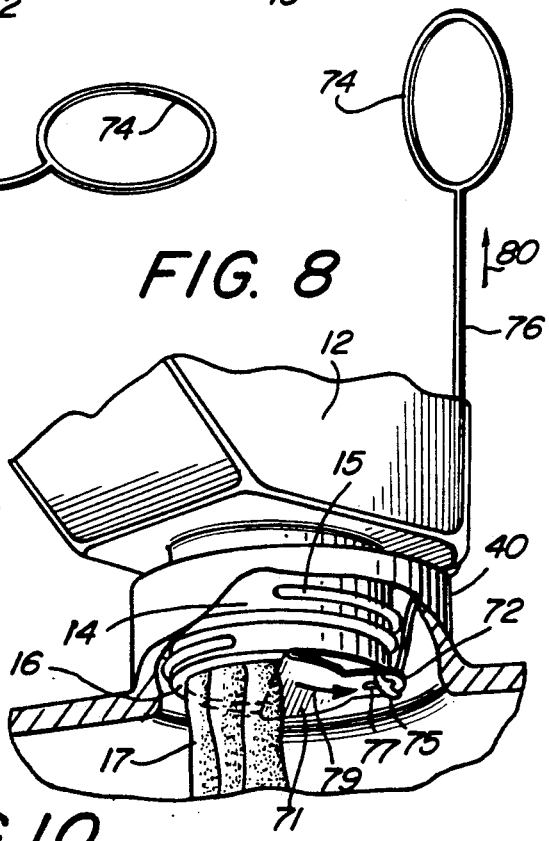
FIG. 8 sets forth a perspective view of the embodiment of FIGS. 6 and 7 at the completion of the oil filling operation.

FIGS. 7 and 8 set forth perspective views of the operation of the embodiment of FIG. 6. With reference specifically to FIG. 7, cap 11 has been removed exposing seal membrane 71 secured to edge 16. Bottle 12 includes an upwardly extending neck 14 having an upper edge 16 to which seal member 71 is secured by a peelable adhesive. Tab 72, which in the capped position shown in FIG. 6 was preferably folded upon seal member 71, has been unfolded to extend outwardly from seal member 71. Tab 72 defines an aperture 77 which receives hook 75 of puller 73. Once hook 75 is received within aperture 77, bottle 12 may be inverted and inserted into an oil filler spout 40 as shown in FIG. 8.

FIG. 8 shows bottle 12 inverted and positioned such that neck 14 extends into filler spout 40 which, as mentioned above, typifies a conventional oil filling spout or aperture of a typical vehicle engine. Initially, bottle 12 is inverted above oil filler spout 40 and tab 72 is coupled to hook 75 of puller 73. Thereafter, puller 73 is positioned on the side of bottle 12 opposite to the side from which tab 72 extends. Thus, tab 72 is drawn back upon seal member 71 such that a drawing force applied to ring 74 by the user in the direction indicated by arrow 80 causes seal member 71 to be peeled away from edge 16 of neck 14 in the direction indicated by arrow 79. As seal member 71 is peeled from edge 16, neck 14 is opened and a stream of oil 17 flows from bottle 12 to the vehicle engine.

Thus, it will be apparent to those skilled in the art that the embodiment shown in FIGS. 6, 7 and 8 function substantially in accordance with that shown in FIGS. 1 through 4 but differs in that puller 73 is maintained apart from seal membrane 71 and thus the multiple folds of the tab extension of the above embodiment need not be accommodated within cap 11.

Figure 9:
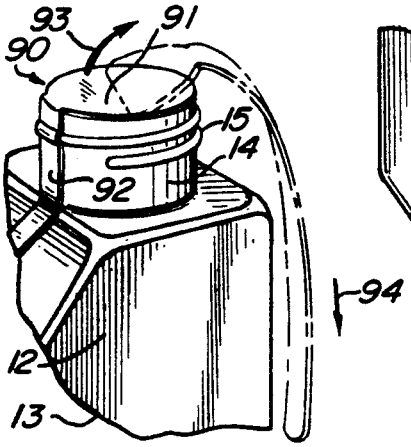
FIG. 9 sets forth a perspective view of a still further alternate embodiment of the present invention.

FIG. 9 sets forth a perspective view of a still further alternate embodiment of the present invention generally referenced by numeral 90. Bottle 12 is formed in the manner described above and defines an upwardly extending cylindrical neck 14 having a plurality of external threads 15 and an upper edge 16. A seal membrane 91 which conforms generally to seal membrane 20 shown above in FIGS. 1 through 4 defines a tab 92 extending outwardly therefrom. The embodiment shown in FIG. 9 differs, however, from the embodiment of FIGS. 1 through 4 in that tab 92 is not folded to be supported within cap 11 but is instead passed outwardly and downwardly over the exterior of neck 14. Thus, cap 11 is threadably received upon neck 14 in the manner described above such that tab 92 passes between the side portions of cap 11 and extends beyond cap 11 as shown in FIG. 9. In all other respects, however, seal 90 is operative in the same manner as described above for the embodiment shown in FIGS. 1 through 4 in that bottle 12 is inverted and tab 92 is drawn in the manner shown by arrow 94 and the dashed line outline of tab 92 to peel seal membrane 91 away from edge 16 in the direction indicated by arrow 93.

Figure 10:
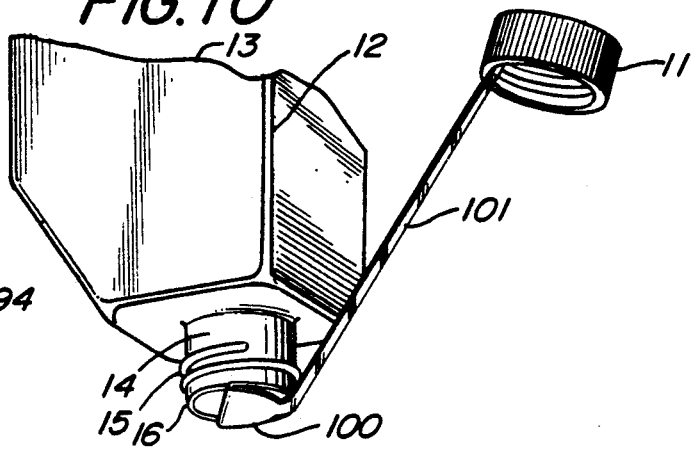
FIG. 10 sets forth an additional alternate embodiment of the present invention removable seal.

FIG. 10 sets forth a still further alternate embodiment of the present invention in which bottle 12 is configured in the manner shown above and, as described above, defines a cylindrical neck 14 having an upper edge 16 and a plurality of threads 15. The embodiment of FIG. 10 includes a seal membrane 100 which conforms generally to seal membrane 20 in the embodiment shown in FIGS. 1 through 4. Thus, tab extension 101 is folded and received between seal membrane 100 and cap 11 when cap 11 is threadably received upon neck 14 in the manner described above. The embodiment shown in FIG. 10, however, differs from that shown in FIG. 1 in that the extreme end of tab extension 101 is secured to the interior of cap 11. The attachment of the extreme end of tab extension 101 to the interior of cap 11 may be accomplished during the bottling process by providing an adhesive attachment therebetween which is completed as cap 11 is threadably received upon neck 14 in accordance with conventional fabrication techniques.

Thus, in operation as cap 11 is threaded from neck 14 to remove cap 11, tab extension 101 is multiply twisted to form the twisted structure shown in FIG. 10. Thereafter, with cap 11 still attached to tab extension 101, bottle 12 may be inverted and placed such that neck 14 extends into the vehicle filler spout or aperture as described above. The attachment between cap 11 and tab extension 101 provides an added convenience in that cap 11 becomes a convenient knob or gripping element for the user to grasp while pulling seal membrane 100 from edge 16 to discharge the oil within bottle 12. Thus, cap 11 is conveniently utilized rather than discarded. In addition, the attachment of tab extension 101 to cap 11 in the embodiment of FIG. 10 assures that cap 11 will not be accidentally dropped during the filling process.

What has been shown is a convenient, inexpensive and highly effective removable seal for a liquid container such as motor oil. The system shown in the various embodiments above adds little or no cost to the bottling or filling process and is compatible with the presently used high speed automated filling processes.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a liquid container having an extending neck defining a neck passage, a surrounding sealing edge and a container cap receivable upon the extending neck, a removable seal comprising:

a thin flexible seal membrane mixed and shaped to overlie at least a portion of the sealing edge and closing the neck passage;

a tab portion extending from said seal membrane; and means for removably affixing said seal membrane exclusive of said tab portion to the seal edge of the neck in a peelable sealing attachment, at least a portion of said tab portion being received within the cap when the cap is placed upon the neck, said tab portion including a tab extension forming a plurality of folds and said seal membrane forming a recess for receiving said folds beneath the cap.

2. A removable seal as set forth in claim 1 wherein said seal membrane, said tab portion and said tab extension are formed of a single piece of thin flexible material.

3. A removable seal as set forth in claim 2 wherein the neck and the cap of the liquid container define cooperating threads.

4. A removable seal as set forth in claim 1 wherein said seal membrane supports a visible indicia for direction of pull indication.

5. A removable seal as set forth in claim 1 wherein said thin flexible seal membrane is received within the container cap and supported therein prior to and during assembly of the container cap to the extending neck of the container.

6. For use in combination with a liquid container having an extending neck defining a neck passage, a surrounding sealing edge and a container cap receivable upon the extending neck, a removable seal comprising:

a thin flexible seal membrane sized and shaped to overlie at least portion of the sealing edge and closing the neck passage;

a tab portion extending from said seal membrane; and means for removably affixing said seal membrane exclusive of said tab portion to the sealing edge of the neck in a peelable sealing attachment, said tab portion including a tab extension forming a plurality of folds and wherein said seal membrane forms a recess for receiving said folds beneath the cap, said tab extension defining an end portion extending beyond said plurality of folds when said tab extension is folded.

7. A removable seal as set forth in claim 6 wherein said tab portion has a length greater than the diameter of the extending neck of the container.

* * * * *